US006344094B1

(12) United States Patent
Hineno et al.

(10) Patent No.: US 6,344,094 B1
(45) Date of Patent: Feb. 5, 2002

(54) FERRITIC-AUSTENITIC TWO-PHASE STAINLESS STEEL

(75) Inventors: Makoto Hineno, Hirakata; Takeshi Torigoe, Kyoto, both of (JP)

(73) Assignee: Kubota Corporation, Osaka (JP)

( * ) Notice: Subject to any disclaimer, the term of this patent is extended or adjusted under 35 U.S.C. 154(b) by 0 days.

(21) Appl. No.: 09/592,408

(22) Filed: Jun. 13, 2000

(30) Foreign Application Priority Data

Jun. 15, 1999 (JP) ..... 11-168080

(51) Int. Cl.[7] ..... C22C 38/44; C22C 38/42
(52) U.S. Cl. ..... 148/325; 420/41; 420/61
(58) Field of Search ..... 148/325; 420/41, 420/61

(56) References Cited

U.S. PATENT DOCUMENTS

| | | | | |
|---|---|---|---|---|
| 4,798,635 | A | 1/1989 | Bernhardsson et al. | 148/325 |
| 5,238,508 | A | 8/1993 | Yoshitake et al. | 148/325 |
| 5,672,315 | A | 9/1997 | Okato et al. | 420/40 |

FOREIGN PATENT DOCUMENTS

| | | |
|---|---|---|
| EP | 0 337 846 | 10/1989 |
| JP | 06-145903 | 5/1994 |
| JP | 10-102206 | 4/1998 |

*Primary Examiner*—Deborah Yee
(74) *Attorney, Agent, or Firm*—Armstrong, Westerman, Hattori, McLeland & Naughton, LLP

(57) ABSTRACT

A ferritic-austenitic two-phase stainless steel consisting essentially of, in wt. %, over 0% to not more than 0.05% of C, 0.1 to 2.0% of Si, 0.1 to 2.0 of Mn, 20.0 to 23.0% of Cr, 3.0 to 3.9% of Ni, 0.5 to 1.4% of Mo, over 0% to not more than 2.0% of Cu and 0.05 to 0.2% of N, the steel further containing, when desired, at least one element selected from the group consisting of over 0% to not more than 0.5% of Ti, over 0% to not more than 0.5% of Nb, over 0% to not more than 1.0% of V, over 0% to not more than 0.5% of Al, over 0% to not more than 0.5% of Zr, over 0% to not more than 0.5% of B, over 0% to not more than 0.2% of a rare-earth element, over 0% to not more than 1.0% of Co, over 0% to not more than 1.0% of Ta and over 0% to not more than 1.0% of Bi, the balance being substantially Fe. Cr, Mo and N are within the range defined by the following expression [i]:

$$Cr+3.3\times Mo+16\times N \leqq 28\% \quad [i]$$

The metal structure of the stainless steel is 45 to 80% in the area ratio α% of a ferritic phase therein. Cr and N are further within the range defined by the following expression [ii]:

$$0.2\times(Cr/N)+25 \leqq \alpha \quad [ii]$$

12 Claims, 1 Drawing Sheet

FERRITIC-AUSTENITIC TWO-PHASE STAINLESS STEEL

FIELD OF THE INVENTION

The present invention relates to ferritic-austenitic two-phase stainless steel which is excellent particularly in thermal fatigue resistance and corrosion fatigue resistance and useful, for example, as a material for suction rolls for use in paper machines, and also to suction roll shell members prepared from the stainless steel.

BACKGROUND OF THE INVENTION

The suction roll of the paper machine is a perforated roll for use in removing water from wet paper in the form of a web, and the shell portion of the roll is in the form of a hollow cylinder formed with a multiplicity of pores through which the water to be separated from the wet paper, i.e., so-called "white water (strongly acidic corrosive liquid containing $Cl^-$, $SO_4^{2-}$, etc.)" is removed by suction. These pores are termed "suction holes". The roll has as many as hundreds of thousands of suction holes, and the opening area ratio of the roll corresponds to about 20 to about 50% of the circumferential area of the roll shell portion.

The suction roll is not only exposed to the severe corrosive environment described but also subjected over the surface of its shell portion to a high pressure (nipping pressure) by a press roll for expressing water from the wet paper, and therefore has the problem of being liable to crack owing to corrosion fatigue. This problem has been handled by improving the material with use of two-phase stainless steel as a base, especially by giving enhanced corrosion fatigue strength to the material.

With increases in the papermaking speed in recent years, use of suction rolls in actual machines has encountered another problem anew. The heat of friction between the seals of the suction box and the roll shell portion in contact therewith raises the temperature of the inner surface of the roll shell portion, for example, to 300 to 350° C., rendering the roll shell portion susceptible to cracking due to thermal fatigue caused by heat cycles.

With reference to FIG. 1, indicated at 1 is the shell portion of a suction roll, at 2 a press roll, and at 3 a suction box disposed in the interior of the shell portion of the suction roll. The roll 1 is formed with a multiplicity of suction holes 11. The suction box 3 bears on the inner peripheral surface of the roll shell portion 1, with seals 31 of phenolic resin or graphite interposed therebetween. Wet paper 5 is held by felt 4 and passes between the suction roll 1 and the press roll 2, as timed with the peripheral speed of the rolls. The water expressed from the paper is removed by the suction of the suction box 3 through the suction holes 11.

The heat generated by the friction of the seals 31 described is attributable mainly to maintenance problems such as an insufficient supply of lubricating water to the seals and excessive pressure applied to the seals against the roll inner peripheral surface. However, increases in the papermaking speed present difficulty in ensuring perfect maintenance for preventing these problems, entailing an increased likelihood of greater friction of the seals. It is therefore demanded to provide a novel roll material which is adapted to obviate the cracking of the suction roll and the shortening of roll life due to thermal fatigue.

To meet the demand, the present invention provides a two-phase stainless steel which has improved thermal fatigue resistance, realizes savings in the quantities of expensive and scarce elements such as Cr, Mo and Ni so as to be more economical, and has satisfactory workability with drills when used for making suction rolls.

SUMMARY OF THE INVENTION

The present invention provides a ferritic-austenitic two-phase stainless steel consisting essentially of, in wt. %, over 0% to not more than 0.05% of C, 0.1 to 2.0% of Si, 0.1 to 2.0% of Mn, 20.0 to 23.0% of Cr, 3.0 to 3.9% of Ni, 0.5 to 1.4% of Mo, over 0% to not more than 2.0% of Cu, 0.05 to 0.2% of N and the balance substantially Fe, Cr, Mo and N being within the range defined by the following expression [i]:

$$Cr+3.3\times Mo+16\times N\leqq 28\% \quad [i]$$

the metal structure of the stainless steel being 45 to 80% in the area ratio α% of a ferritic phase therein, Cr and N further being within the range defined by the following expression [ii]:

$$0.2\times(Cr/N)+25\leqq\alpha \quad [ii]$$

When desired, at least one element can be incorporated into the ferritic-austenitic two-phase stainless steel of the invention, the element being selected from the group consisting of over 0% to not more than 0.5% of Ti, over 0% to not more than 0.5% of Nb, over 0% to not more than 1.0% of V, over 0% to not more than 0.5% of Al, over 0% to not more than 0.5% of Zr, over 0% to not more than 0.5% of B, over 0% to not more than 0.2% of a rare-earth element, over 0% to not more than 1.0% of Co, over 0% to not more than 1.0% of Ta and over 0% to not more than 1.0% of Bi.

Cr, Mo and like element present in two-phase stainless steels exert a great influence on the corrosion resistance of the steel, and it is said that the corrosion resistance increases generally as the content of such an element increases. However, these elements are expensive and scarce and are each a ferrite former, so that if they are used in an increased amount, there arises a need to add an increased amount of Ni which is an austenite former and is similarly a scarce element, in view of the component balance. On the other hand, increases in the quantities of these elements entail a reduction in the workability by drilling.

The two-phase stainless steel of the present invention is improved in thermal fatigue resistance and corrosion fatigue resistance characteristics and is satisfactory in workability with drills while ensuring savings in the quantities of these scarce elements to be used.

DETAILED DESCRIPTION OF THE INVENTION

Figure 1:
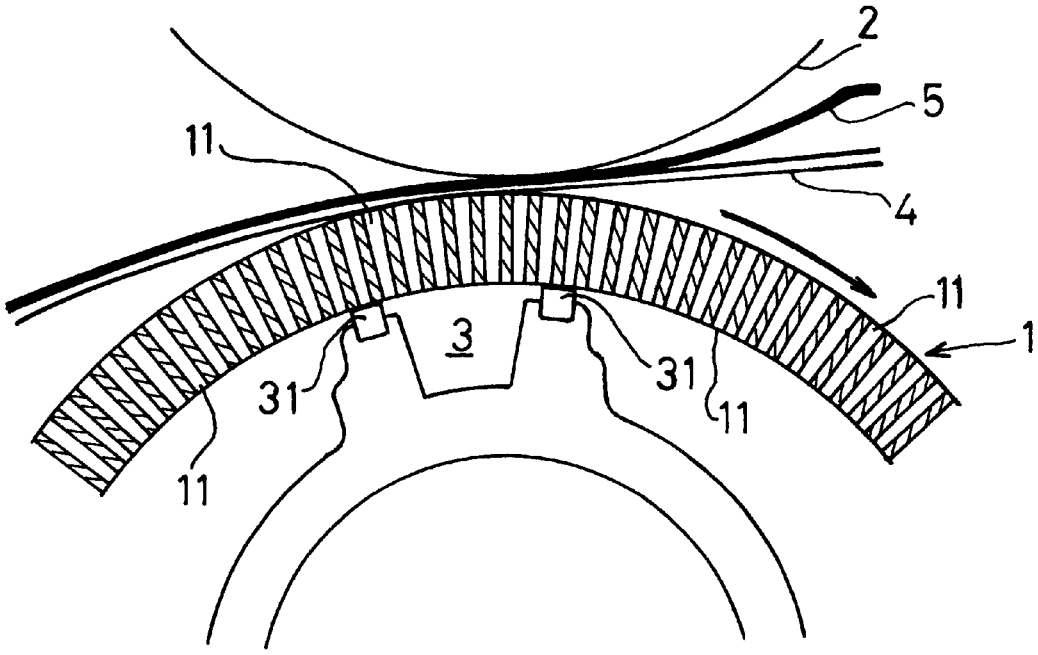
FIG. 1 is a diagram in section for illustrating a suction roll portion in a papermaking process.

Given below are reasons for limiting the contents of the components of the two-phase stainless steel of the present invention. The percentages indicating the contents of the elements are all by weight.

C: over 0% to not more than 0.05%

C acts to enhance the strength of the alloy by forming a fortified solid solution. However, an increase in the C content results in precipitation of chromium carbides to entail impaired toughness and lower corrosion resistance. Accordingly, the upper limit is 0.05%.

Si: 0.1–2.0%

Si serves as a deoxidizer when the alloy is prepared by melting and is an element for giving improved fluidity to the molten metal to be cast. At least 0.1% of Si should therefore be present. If used in a large amount, however, Si lowers the toughness and weldability of the alloy, so that the upper limit is 2.0%.

Mn: 0.1–2.0%

Mn is used as a deoxidizing and desulfurizing element. To obtain this effect, at least 0.1% of Mn must be used, whereas presence of more than 2.0% of Mn results in impaired corrosion resistance. Accordingly, the content is 0. 1 to 2.0%.

Cr: 20.0–23.0%

Cr forms a ferritic phase in the microstructure, giving increased strength to the alloy. Cr is also an indispensable element for giving the alloy higher corrosion resistance, especially enhanced resistance to pitting corrosion and intergranular corrosion. Accordingly, at least 20.0% of Cr needs to be present. Use of a large amount nevertheless entails lower toughness and lower weldability. The upper limit is therefore 23.0%.

Ni: 3.0–3.9%

Ni is a highly effective austenite forming element, is required for ensuring a balance between ferrite and austenite in a microstructure and increases the toughness of the alloy by forming an austenitic phase. Accordingly, at least 3.0% of Ni must be present. However, the upper limit is 3.9% since Ni is an expensive element.

Mo: 0.5–1.4%

Mo contributes to improvements in corrosion resistance and is effective especially for improvements in pitting corrosion resistance and intergranular corrosion resistance. Use of at least 0.5% of Mo produces this effect. However, Mo is an expensive element like Ni, while an increase in the amount of Mo impairs the toughness of the alloy, so that the upper limit should be 1.4%.

Cu: over 0% to not more than 2.0%

Cu affords improved corrosion resistance and higher intergranular corrosion resistance. However, if the Cu content is in excess of 2.0%, lower toughness and insufficient ductility will result along with impaired corrosion resistance. The upper limit is therefore 2.0%. Preferably, the Cu content is 0.2 to 1.0%.

N: 0.05–0.2%

N is an austenite forming element and permits the Cr, Mo, etc. to be distributed throughout the austenitic phase effectively to enhance the corrosion resistance of the alloy. Further as will be described later, N forms fine particles of precipitates of chromium nitrides within the ferrite grains and at boundaries thereof, contributing to an increase in the resistance to thermal fatigue damage. For this purpose, at least 0.05% of N must be present. Presence of more than 0.2% of N is liable to produce shrinkage cavities in the steel as cast, further disturbing the balance between the ferritic phase and the austenitic phase in the microstructure. The N content is preferably 0.1–0.2%.

The contents of Cr, Mo and N among the foregoing elements exert a great influence on the workability of the steel with drills, To ensure the desired drill workability, therefore, the contents of these elements need to be adjusted relative to one another so as to satisfy the following expression [i].

$$Cr+3.3\times Mo+16\times N\leqq 28\% \quad [i]$$

The smaller the numerical value of the left side member of the expression [i], the higher the drill workability is, and the value should not exceed 28 if it is greatest.

The metal structure (ferritic-austenitic two-phase structure) of the two-phase stainless steel of the invention is made to contain 45 to 80% of the ferritic phase in area ratio $\alpha$% so as to give the steel both strength and toughness as the effect of the balance between the two phases and to afford an enhanced corrosion fatigue strength and satisfactory workability by drilling to the steel. If the quantity of ferrite is less than 45%, an insufficient strength and lower drill workability will result. Although an increase in the proportion of ferrite is advantageous in increasing the corrosion fatigue strength, over 80% of ferrite entails a marked reduction in toughness.

The contents of Cr and N among the foregoing elements further need to be adjusted relative to each other so as to satisfy the following expression [ii] in connection with the area ratio of the ferritic phase.

$$0.2\times(Cr/N)+25\leqq\alpha \quad [ii]$$

This expression [ii] defines the adjustment of the two components to transgranularly and intergranularly fortify the ferritic phase of the metallic microstructure by the precipitation of fine particles of chromium nitrides and to give enhanced resistance to thermal fatigue damage. Stated more specifically, ferrite and austenite are different in coefficient of thermal expansion, and austenite is greater than ferrite in coefficient of thermal expansion, so that in the case where a suction roll is made from the steel and actually used, microscopic thermal stresses are set up in the steel. During the rise of temperature of the shell portion inner surface due to the friction between the surface and the suction box seals, these stresses are compressive in the austenite grains and tensile in the ferrite grains, while the thermal stresses produced in the cooling process are tensile in the austenite grains and compressive in the ferrite grains. Owing to repetitions of rise and fall of temperature due to the rotation of the roll, the ferrite grains and the austenite grains are repeated subjected to the thermal stresses of compression and tension while these stresses are being reversed. In addition to these stresses, a thermal stress of shear acts at the grain boundaries, as superposed on the stresses.

Detailed investigations of materials used in actual machines have revealed that such repeated thermal stresses at the grain boundaries and in the ferrite grains give rise to a break, and microcracks occurring in the initial stage gradually combine and grow into a fracture.

Further studies have revealed that when the Cr and N contents are so adjusted as to satisfy the expression [ii], chromium nitrides precipitate to strengthen the ferrite grains and grain boundaries during the slow cooling process of solution treatment of the material as cast, whereby thermal fatigue damage can be diminished.

When required, at least one of Ti, Nb, V, Al, Zr, B, a rare-earth element (hereinafter referred to as a "REM"), Co, Ta and Bi is added to the two-phase stainless steel of the present invention.

When used, a very small amount of Ti, Nb, V, Al, Zr, B or REM makes the crystal grains finer and enhances the strength of the alloy, further improving the alloy in workability by drilling. However, use of a large amount of these elements results in not only poor economy but also impaired toughness and other drawback. For this reason, the upper limits of these elements are 0.5% for Ti, 0.5% for Nb, 1.0% for V, 0.5% for Al, 0.5% for Zr, 0.5% for B and 0. 2% for REM. The term REMs refers generally to Sc, Y and 15 elements of lanthanides (with atomic numbers of 57 to 71).

Use of a small amount of Co or Ta is effective for giving improved corrosion resistance, whereas increases in the amount lead to lower workability by drilling. Accordingly, the upper limits are 1.0% for Co, and 1.0% for Ta.

Bi has an effect to afford improved workability by drilling if used in an amount of up to 1.0%. An excess of this element results in poor economy.

The two-phase stainless steel of the invention comprises the foregoing elements and the balance which is substantially Fe. The term "substantially" means to permit the presence of impurity elements which inevitably become incorporated into the steel when the steel is made by melting the components.

The suction roll shell member of the two-phase stainless steel of the invention for use in papermaking is produced by preparing a hollow cylindrical body from the steel by centrifugal casting, subjecting the body to solution treatment, and making suction holes in the body by drilling, followed by finishing.

The solution treatment is conducted to dissolve the carbides in the cast structure into a solid solution, eliminate microsegregation and effect homogenization. Preferably, the solution treatment is conducted by holding the cylindrical body in the ferritic-austenitic two phase temperature range of about 900 to about 1100° C. for a suitable period of time (about 1 hour per inch of the wall thickness) to fully dissolve the carbides and to effect homogenization. At temperatures lower than 900° C., a sigma phase is likely to occur, possibly rendering the steel brittle, while temperatures higher than 1100° C. are not only likely to disturb the balance between the proportions of the ferrite and austenite but also uneconomical thermally, imposing an increased burden on the maintenance of the furnace.

The cylindrical body can be cooled from the temperature of solution treatment by cooling the furnace with the body placed therein, or cooling the body in the air outside the furnace. To assure further improved thermal fatigue resistance and reduced residual stress, it is desirable to cool the body slowly at a rate of 0.5 to 5° C./min, because if this rate is up to 5° C./min, a remarkable effect to reduce the residual stress is available, and the precipitation of chromium nitrides described is expected to strengthen the ferrite grains and grain boundaries for a further improvement in thermal fatigue resistance, and also because cooling rates lower than 0.5° C./min are undesirable from the viewpoint of productivity.

EXAMPLES

Hollow cylindrical bodies were made by centrifugal casting, then heat-treated and machined to prepare specimens measuring 250 mm in outside diameter, 50 mm in wall thickness and 250 mm in length. For each specimen, Table 1 shows the chemical composition, calculated values of the foregoing expressions [i] and [ii] and the area ratio α% of the ferritic phase.

Each of the specimens was subjected to solution treatment by holding the specimen heated at 1030° C. for 2 hours. Table 1 also shows the rate of cooling after the heating.

The specimen was checked for mechanical properties with respect to 0.2% proof stress, tensile strength at room temperature, elongation and impact value.

A corrosion test was conducted according to ASTM, Method G48 to measure the corrosion weight loss ($g/m^2h$) due to corrosion. The corrosion test was conducted for 72 hours using a ferric chloride solution (6% in concentration, 50° C. in temperature).

For a thermal fatigue test, the specimen was heated and cooled repeatedly, and evaluated in terms of the number of repetitions of heating and cooling until the specimen developed a crack. The specimen was heated by applying heat to the inner surface thereof with a high-frequency heating coil, and was cooled by forcibly cooling the outer surface thereof with a cooling water pipe. The highest temperature of the specimen was 400° C., the lowest temperature thereof 50° C., the rate of rise of temperature 1° C./sec, and the rate of drop of temperature 1° C./sec.

A corrosion fatigue test was conducting using an Ono rotating bending fatigue tester in a corrosive atmosphere until a fatigue failure occurred in the test piece to determine the number of repetitions of bending. The test piece used was one prescribed in JIS, Z2274 as No. 1 (10 mm in the diameter of parallel portions, 35 mm in length). The corrosive solution (TAPPI II) used contained 1000 ppm of $Cl^-$ and 1000 ppm of $SO_4^{2-}$ and had a pH of 3.5. The speed of rotation was 3000 rpm, and the stress amplitude was a constant value of 300 MPa.

The workability by drilling was evaluated in terms of the quantity of wear on the drill cutting edges resulting from drilling. The drill used was a gun drill made of cemented carbide and having a diameter of 4.0 mm. The specimen was drilled under the conditions of 10 m in cutting length, 4500 rpm in the speed of rotation, 60 mm/min in feed speed and 50 $kg/cm^2$ in cutting oil pressure.

The hollow cylindrical body of the specimen was checked for residual stress by the ring cut method.

Table 2 shows the measurements obtained with respect to the mechanical properties (0.2% proof stress, tensile strength, elongation, impact value), corrosion weight loss (corrosion resistance), number of repetitions of temperature changes in the thermal fatigue strength test which resulted in cracking (thermal fatigue resistance), number of repetitions of bending in the corrosion fatigue strength test which resulted in failure (corrosion fatigue resistance), wear on the drill cutting edges (workability by drilling), and residual stress.

TABLE 1

| | Chemical Composition (Bal. substantially Fe) (wt. %) | | | | | | | | | [i] | [ii] | Ferritic Phase | Cooling Rate |
|---|---|---|---|---|---|---|---|---|---|---|---|---|---|
| No. | C | Si | Mn | Cr | Ni | Mo | Cu | N | Other Elements | (%) | Left Side | Area Ratio α % | (° C./min) |
| Invention Example | | | | | | | | | | | | | |
| 1 | 0.018 | 0.61 | 0.68 | 20.13 | 3.05 | 0.83 | 0.37 | 0.152 | — | 25.3 | 51 | 52 | 2.0 |
| 2 | 0.021 | 0.48 | 0.50 | 20.61 | 3.22 | 0.96 | 0.39 | 0.153 | — | 26.2 | 52 | 57 | 2.0 |
| 3 | 0.021 | 0.51 | 0.64 | 21.30 | 3.29 | 1.03 | 0.38 | 0.143 | — | 27.0 | 55 | 58 | 2.0 |
| 4 | 0.018 | 0.56 | 0.47 | 21.54 | 3.44 | 0.96 | 0.33 | 0.128 | — | 26.8 | 59 | 65 | 2.0 |
| 5 | 0.023 | 0.53 | 0.60 | 22.49 | 3.25 | 1.11 | 0.35 | 0.115 | — | 28.0 | 64 | 75 | 2.0 |
| 6 | 0.022 | 0.56 | 0.83 | 20.90 | 3.16 | 0.74 | 0.39 | 0.127 | — | 25.4 | 58 | 60 | 0.5 |
| 7 | 0.020 | 0.50 | 0.89 | 22.51 | 3.38 | 0.80 | 0.38 | 0.140 | — | 27.4 | 57 | 60 | 1.0 |

TABLE 1-continued

| No. | Chemical Composition (Bal. substantially Fe) (wt. %) C | Si | Mn | Cr | Ni | Mo | Cu | N | Other Elements | [i] (%) | [ii] Left Side | Ferritic Phase Area Ratio α % | Cooling Rate (° C./min) |
|---|---|---|---|---|---|---|---|---|---|---|---|---|---|
| 8 | 0.027 | 0.87 | 0.64 | 21.81 | 3.41 | 0.79 | 0.37 | 0.123 | — | 26.4 | 60 | 63 | 5.0 |
| 9 | 0.026 | 0.80 | 0.73 | 21.92 | 3.32 | 0.78 | 0.40 | 0.119 | Ti: 0.21 | 26.4 | 62 | 67 | 2.0 |
| 10 | 0.024 | 0.59 | 0.65 | 21.40 | 3.31 | 0.69 | 0.39 | 0.115 | Nb: 0.25 | 25.5 | 62 | 65 | 2.0 |
| 11 | 0.022 | 0.58 | 0.62 | 21.33 | 3.38 | 0.71 | 0.38 | 0.121 | V: 0.62 | 25.6 | 60 | 63 | 2.0 |
| 12 | 0.022 | 0.59 | 0.62 | 21.31 | 3.35 | 0.72 | 0.39 | 0.123 | Al: 0.23 | 25.7 | 60 | 62 | 2.0 |
| 13 | 0.022 | 0.58 | 0.60 | 21.34 | 3.34 | 0.73 | 0.41 | 0.124 | Zr: 0.22 | 25.7 | 59 | 63 | 2.0 |
| 14 | 0.022 | 0.59 | 0.59 | 21.38 | 3.43 | 0.72 | 0.40 | 0.121 | Co: 0.78 | 25.7 | 60 | 63 | 2.0 |
| 15 | 0.022 | 0.58 | 0.63 | 21.28 | 3.39 | 0.73 | 0.40 | 0.120 | B: 0.31 | 25.6 | 60 | 63 | 2.0 |
| 16 | 0.023 | 0.55 | 0.64 | 21.31 | 3.36 | 0.72 | 0.38 | 0.131 | Ta: 0.61 | 25.8 | 58 | 58 | 2.0 |
| 17 | 0.023 | 0.57 | 0.62 | 21.41 | 3.33 | 0.75 | 0.40 | 0.133 | Bi: 0.51 | 26.0 | 57 | 59 | 2.0 |
| 18 | 0.022 | 0.58 | 0.63 | 21.37 | 3.29 | 0.73 | 0.39 | 0.130 | REM: 0.08 | 25.9 | 58 | 61 | 2.0 |
| 19 | 0.022 | 0.58 | 0.57 | 21.53 | 3.18 | 0.81 | 0.37 | 0.139 | Ti:0.22, Ta:0.28 | 26.4 | 56 | 62 | 2.0 |
| 20 | 0.023 | 0.45 | 0.50 | 21.51 | 3.15 | 0.82 | 0.33 | 0.148 | V:0.22, Bi:0.31 | 26.6 | 54 | 57 | 2.0 |
| 21 | 0.022 | 0.56 | 0.53 | 21.49 | 3.20 | 0.84 | 0.37 | 0.150 | Co:0.58, Bi:0.41 | 26.7 | 54 | 57 | 2.0 |
| 22 | 0.020 | 0.51 | 0.59 | 21.61 | 3.18 | 0.79 | 0.36 | 0.149 | V:0.33, Ta:0.50, Bi:0.46 | 26.6 | 54 | 58 | 2.0 |
| 23 | 0.023 | 0.56 | 0.51 | 21.39 | 3.17 | 0.82 | 0.35 | 0.135 | — | 26.3 | 57 | 62 | 6.0 |
| Comp. Ex. | | | | | | | | | | | | | |
| 51 | 0.022 | 1.30 | 1.23 | 19.46 | 5.02 | 2.68 | — | 0.105 | — | 30.0 | 62 | 55 | 2.0 |
| 52 | 0.022 | 1.28 | 1.20 | 19.76 | 5.08 | 2.53 | — | 0.101 | — | 29.7 | 64 | 55 | 2.0 |
| 53 | 0.023 | 0.56 | 0.61 | 22.09 | 4.54 | 1.52 | — | 0.145 | — | 29.4 | 55 | 51 | 2.0 |
| 54 | 0.020 | 0.38 | 0.79 | 20.43 | 3.47 | 1.40 | — | 0.165 | — | 27.9 | 50 | 41 | 2.0 |
| 55 | 0.020 | 0.52 | 0.41 | 21.53 | 3.15 | 1.39 | — | 0.097 | — | 27.7 | 69 | 82 | 2.0 |
| 56 | 0.018 | 0.48 | 0.60 | 20.61 | 3.72 | 0.86 | — | 0.107 | — | 25.2 | 64 | 55 | 2.0 |
| 57 | 0.020 | 0.58 | 0.69 | 19.53 | 2.47 | 0.66 | — | 0.135 | — | 23.9 | 54 | 55 | 2.0 |
| 58 | 0.017 | 0.44 | 0.45 | 20.44 | 2.48 | 0.72 | — | 0.147 | — | 25.2 | 53 | 60 | 2.0 |
| 59 | 0.020 | 0.56 | 0.81 | 20.90 | 3.47 | 1.35 | 0.35 | 0.165 | — | 28.0 | 50 | 45 | 2.0 |

30

TABLE 2

| No. | Mechanical Properties 0.2% Proof Stress (MPa) | Tensile Strength (MPa) | Elon-gation (%) | Impact Value (J/cm$^2$) | Corrosion Weight Loss (g/m$^2$h) | Thermal Fatigue Strength (times) | Corrosion Fatigue Strength (times) | Drill Edge Wear (mm) | Cylinder Inner Surface Residual Stress (MPa) |
|---|---|---|---|---|---|---|---|---|---|
| Invention Example | | | | | | | | | |
| 1 | 413 | 715 | 34.2 | 83 | 9.8 | 27000 | $3.05 \times 10^6$ | 0.080 | 15 |
| 2 | 434 | 749 | 36.8 | 88 | 8.3 | 29000 | $3.37 \times 10^6$ | 0.095 | 14 |
| 3 | 436 | 773 | 43.2 | 76 | 7.4 | 34000 | $3.29 \times 10^6$ | 0.110 | 14 |
| 4 | 454 | 754 | 43.6 | 62 | 8.3 | 37000 | $3.53 \times 10^6$ | 0.094 | 14 |
| 5 | 456 | 785 | 42.1 | 54 | 6.9 | 40000 | $3.28 \times 10^6$ | 0.125 | 14 |
| 6 | 439 | 769 | 44.3 | 71 | 8.2 | 25000 | $3.93 \times 10^6$ | 0.083 | 10 |
| 7 | 425 | 765 | 45.3 | 82 | 9.5 | 42000 | $3.75 \times 10^6$ | 0.119 | 12 |
| 8 | 427 | 749 | 44.5 | 106 | 10.1 | 20000 | $3.63 \times 10^6$ | 0.099 | 20 |
| 9 | 431 | 744 | 46.2 | 53 | 11.4 | 37000 | $3.22 \times 10^6$ | 0.098 | 14 |
| 10 | 422 | 753 | 45.9 | 54 | 13.0 | 39000 | $3.25 \times 10^6$ | 0.092 | 14 |
| 11 | 430 | 748 | 45.1 | 90 | 12.7 | 40000 | $3.32 \times 10^6$ | 0.095 | 14 |
| 12 | 435 | 755 | 40.2 | 72 | 13.5 | 33000 | $2.97 \times 10^6$ | 0.113 | 14 |
| 13 | 436 | 743 | 36.2 | 62 | 11.5 | 29000 | $2.69 \times 10^6$ | 0.103 | 14 |
| 14 | 433 | 748 | 45.1 | 102 | 9.2 | 32000 | $2.91 \times 10^6$ | 0.089 | 14 |
| 15 | 435 | 757 | 44.9 | 68 | 10.2 | 35000 | $3.70 \times 10^6$ | 0.085 | 14 |
| 16 | 448 | 755 | 41.5 | 85 | 12.6 | 34000 | $3.41 \times 10^6$ | 0.088 | 14 |
| 17 | 449 | 757 | 41.5 | 57 | 12.6 | 33000 | $3.50 \times 10^6$ | 0.083 | 14 |
| 18 | 445 | 765 | 43.9 | 77 | 12.3 | 39000 | $3.70 \times 10^6$ | 0.082 | 14 |
| 19 | 460 | 773 | 40.7 | 51 | 7.7 | 35000 | $3.73 \times 10^6$ | 0.092 | 14 |
| 20 | 467 | 779 | 41.4 | 54 | 11.5 | 34000 | $3.45 \times 10^6$ | 0.070 | 14 |
| 21 | 435 | 733 | 40.3 | 61 | 8.3 | 33000 | $3.38 \times 10^6$ | 0.072 | 14 |
| 22 | 492 | 795 | 39.9 | 53 | 8.0 | 34000 | $3.35 \times 10^6$ | 0.069 | 14 |
| 23 | 424 | 698 | 41.0 | 71 | 9.1 | 19000 | $3.01 \times 10^6$ | 0.105 | 32 |
| Comp. Ex. | | | | | | | | | |
| 51 | 404 | 696 | 18.2 | 13 | 21.7 | 9000 | $1.25 \times 10^6$ | 0.162 | 14 |

TABLE 2-continued

| | Mechanical Properties | | | | Corrosion | Thermal | Corrosion | Drill | Cylinder |
|---|---|---|---|---|---|---|---|---|---|
| No. | 0.2% Proof Stress (MPa) | Tensile Strength (MPa) | Elon-gation (%) | Impact Value (J/cm$^2$) | Weight Loss (g/m$^2$h) | Fatigue Strength (times) | Fatigue Strength (times) | Edge Wear (mm) | Inner Surface Residual Stress (MPa) |
| 52 | 407 | 685 | 37.5 | 94 | 9.2 | 7000 | $1.95 \times 10^6$ | 0.117 | 17 |
| 53 | 411 | 641 | 19.1 | 16 | 22.6 | 12000 | $2.15 \times 10^6$ | 0.158 | 14 |
| 54 | 446 | 650 | 20.9 | 83 | 12.3 | 14000 | $1.90 \times 10^6$ | 0.115 | 14 |
| 55 | 453 | 679 | 33.2 | 25 | 19.3 | 15000 | $1.75 \times 10^6$ | 0.122 | 14 |
| 56 | 384 | 749 | 22.8 | 88 | 8.3 | 14000 | $2.28 \times 10^6$ | 0.118 | 14 |
| 57 | 406 | 650 | 18.9 | 13 | 23.0 | 11000 | $1.57 \times 10^6$ | 0.105 | 14 |
| 58 | 417 | 708 | 23.2 | 16 | 20.5 | 12000 | $1.95 \times 10^6$ | 0.088 | 14 |
| 59 | 440 | 665 | 22.8 | 80 | 12.4 | 13000 | $1.95 \times 10^6$ | 0.117 | 14 |

With reference to Tables 1 and 2, No. 1 to No. 23 are Invention Examples, and No. 51 to No. 59 are Comparative Examples.

Among Comparative Examples, No. 51 to No. 53 are materials corresponding to conventional two-phase stainless steels and greater in Cr, Ni, Mo and like contents than Invention Examples. These materials are outside the scope of the invention in the values of the expressions [i] and [ii]. No. 54 is insufficient in the amount of ferrite and fails to satisfy the expression [ii], while No. 55 is excessive in the amount of ferrite. No. 56 also fails to satisfy the expression [ii]. Further No. 57 is insufficient in the amounts of Cr and Ni, and No. 58 is insufficient in the quantity of Ni. No. 59 fails to satisfy the expression [ii], like No. 56.

Comparative Examples No. 51 to No. 53 are low in thermal fatigue resistance and corrosion fatigue resistance and also low in workability with drills. Although satisfactory in drill workability, No. 54 to No. 56 still remain insufficient in thermal fatigue resistance and corrosion fatigue resistance. No. 57 and No. 58 are low in corrosion resistance and insufficient in thermal fatigue resistance and corrosion fatigue resistance. No. 59 is insufficient in thermal fatigue resistance and corrosion fatigue strength, like No. 56.

On the other hand, Invention Examples are excellent in corrosion resistance, thermal fatigue resistance, corrosion fatigue resistance and workability by drilling and have specified mechanical properties. Among Invention Examples, the cooling rate of No. 23 is 6.0° C./min which is faster than others. This results in that No. 23 is a slightly larger residual stress.

Thus, the ferritic-austenitic two-phase stainless steel of the present invention is outstanding in strength, toughness and like mechanical properties, corrosion resistance, corrosion fatigue resistance and thermal fatigue resistance, has satisfactory workability by drilling and is therefore suitable as a material for members, such as suction rolls for use in paper machines, which serve in an environment wherein the material is subjected to both corrosion and mechanical stresses. The steel is usable especially for suction rolls, effectively overcoming the problem of thermal fatigue which is experienced with the roll shell member at increased papermaking speeds. The present steel further has a composition which realizes savings in the quantities of expensive elements such as Ni and Mo and is therefore advantageous also economically.

What is claimed is:

1. A papermaking suction roll shell member prepared from a hollow cylindrical body made of a ferritic-austenitic two-phase stainless steel consisting essentially of, in wt. %, over 0% to not more than 0.05% of C, 0.1 to 2.0% of Si, 0.1 to 2.0% of Mn, 20.0 to 23.0% of Cr, 3.0 to 3.9% of Ni, 0.5 to 1.4% of Mo, over 0% to not more than 2.0% of Cu, 0.05 to 0.2% of N and the balance substantially Fe, the Cr, Mo and N being within the range defined by the expression (i) given below, the metal structure of the stainless steel being 45 to 80% in the area ratio α% of a ferritic phase therein, the Cr and N further being with the range defined by the expression (ii) given below, $$Cr + 3.3 \times Mo + 16 \times N \leqq 28\% \quad \text{(i)}$$

$$0.2 \times (Cr/N) + 25 \leqq \alpha \quad \text{(ii)}$$

said papermaking suction roll shell member being obtained by centrifugal casting, by subjecting the body to solution treatment in a temperature range of 900 to 1100° C., and thereafter cooling the resulting body at a rate of 0.5 to 5° C./min.

2. The papermaking suction roll shell member as defined in claim 1 wherein the stainless steel further contains at least one element selected from the group consisting of over 0% to not more than 0.5% of Ti, over 0% to not more than 0.5% of Nb, over 0% to not more than 1.0% of V, over 0% to not more than 0.5% of Al, over 0% to not more than 0.5% of Zr, over 0% to not more than 0.5% of B and over 0% to not more than 0.2% of a rare-earth element.

3. The papermaking suction roll shell member as defined in claim 1 wherein the stainless steel further contains at least one element selected from the group consisting of over 0% to not more than 1.0% of Co and over 0% to not more than 1.0% of Ta.

4. The papermaking suction roll shell member as defined in claim 2 wherein the stainless steel further contains at least one element selected from the group consisting of over 0% to not more than 1.0% of Co and over 0% to not more than 1.0% of Ta.

5. The papermaking suction roll shell member as defined in claim 1 wherein the stainless steel further contains over 0% to not more than 1.0% of Bi.

6. The papermaking suction roll shell member as defined in claim 2 wherein the stainless steel further contains over 0% to not more than 1.0% of Bi.

7. The papermaking suction roll shell member as defined in claim 3 wherein the stainless steel further contains over 0% to not more than 1.0% of Bi.

8. The papermaking suction roll shell member as defined in claim 4 wherein the stainless steel further contains over 0% to not more than 1.0% of Bi.

9. A ferritic-austenitic two-phase stainless steel consisting essentially of, in wt %, over 0% to not more than 0.5% of C, 0.1 to 2.0% of Si, 0.1 to 2.0% of Mn, 20.0 to 23.0% of Cr, 3.0 to 3.9% of Ni, 0.5 to 1.4% of Mo, over 0% to not more than 2.0% of Cu, 0.05% to 0.2% of N, over 0% to not more than 1.0% of Bi and the balance substantially Fe, the Cr, Mo and N being within the range defined by the expression (i) given below, the metal structure of the stainless steel being 45 to 80% in the area ratio α% of a ferritic phase therein, the Cr and N further being within the range defined by the expression (ii) given below, $$Cr + 3.3 \times Mo + 16 \times N \leqq 28\% \quad \text{(i)}$$

$$0.2 \times (Cr/N) + 25 \leqq \alpha \quad \text{(ii).}$$

10. The ferritic-austenitic two-phase stainless steel according to claim 9 which further contains at least one element selected from the group consisting of over 0% to not more than 0.5% of Ti, over 0% to not more than 0.5% of Nb, over 0% to not more than 1.0% of V, over 0% to not more than 0.5% of Al, over 0% to not more than 0.5% of Zr, over 0% to not more than 0.5% of B and over 0% to not more than 0.2% of a rare-earth element.

11. The ferritic-austenitic two-phase stainless steel according to claim 9 which further contains at least one element selected from the group consisting of over 0% to not more than 1.0% of Co and over 0% to not more than 1.0% of Ta.

12. The ferritic-austenitic two-phase stainless steel according to claim 10 which further contains at least one element selected from the group consisting of over 0% to not more than 1.0% of Co and over 0% to not more than 1.0% of Ta.

* * * * *